US005715961A

United States Patent [19]

Robertson

[11] Patent Number: 5,715,961

[45] Date of Patent: Feb. 10, 1998

[54] UNIVERSAL DISPENSER COVER

[75] Inventor: Robin Robertson, Toledo, Ohio

[73] Assignee: Robertson Distributors, Toledo, Ohio

[21] Appl. No.: 402,348

[22] Filed: Mar. 10, 1995

[51] Int. Cl.[6] ..... B65D 41/16

[52] U.S. Cl. ..... 215/319; 215/348; 215/352; 220/287; 220/377; 206/385; 132/318

[58] Field of Search ..... 215/317, 319–341, 215/346, 348–352, 228, DIG. 7; 220/287–308, 377; 206/385; 132/317, 318; 401/61

[56] References Cited

U.S. PATENT DOCUMENTS

| | | | |
|---|---|---|---|
| 1,151,322 | 8/1915 | Wootten | 220/377 |
| 1,163,805 | 12/1915 | Bonn et al. | 215/228 X |
| 2,140,009 | 12/1938 | Hand . | |
| 2,367,992 | 1/1945 | Berls . | |
| 2,492,144 | 12/1949 | Gora | 215/346 X |
| 2,521,169 | 9/1950 | Haulihan . | |
| 2,584,522 | 2/1952 | Wolf | 215/228 X |
| 2,700,186 | 1/1955 | Stover | 215/352 X |
| 2,840,229 | 6/1958 | Hopgood | 215/346 X |
| 3,350,823 | 11/1967 | Murray | 220/377 X |
| 3,862,614 | 1/1975 | Kovac | 215/317 |
| 4,312,459 | 1/1982 | Leach | 220/256 |
| 5,064,082 | 11/1991 | Lombardi et al. | 220/377 X |

FOREIGN PATENT DOCUMENTS

| | | | |
|---|---|---|---|
| 679238 | 9/1952 | United Kingdom | 215/228 |
| 1191291 | 5/1970 | United Kingdom | 215/DIG. 7 |

*Primary Examiner*—Stephen Cronin
*Attorney, Agent, or Firm*—David C. Purdue; John C. Purdue

[57] ABSTRACT

A universal cover for cosmetic dispensers is disclosed. The cover comprises a cover body having an open end and a closed end and a retainer secured to the cover, adjacent to the open end, for securing the cover to a dispenser. The retainer comprises a ring of foam or other resilient material adhered or otherwise secured to the cover body adjacent to an open end of the cover body. At least a portion of the cover body is transparent or at least color transparent, so that one can view and identify a cosmetic in a cosmetic dispenser with the cover secured thereto.

9 Claims, 1 Drawing Sheet

UNIVERSAL DISPENSER COVER

BACKGROUND OF THE INVENTION

1. Field of the Invention.

The present invention relates generally to field of containers and, more specifically, to the field of covers for cosmetic dispensers.

2. Description of the Prior Art

Generally speaking, today's lipstick dispensers include an outer, generally cylindrical surface which is or can be engaged by the inner surface of a cover and this engagement may or may not involve various known engagement enhancing means, such as lip and groove. Tubes having oval cross sections also present a unique outer surface in some of today's lipstick dispensers. During a search for patents disclosing covers for lipstick dispensers, U.S. Pat. No. 2,140,009 (Hand), U.S. Pat. No. 2,367,992 (Berls) and U.S. Pat. No. 2,521,169 (Houlihan) were noted.

Hand discloses a cosmetic applicator including a housing 6 and a removable cover 8. The cover 8 frictionally engages a reduced portion of the housing of the cosmetic applicator.

Berls discloses a cosmetic case including a base and a cover which can be releasably secured to the base. The patent discloses several means for securing the cover to the base including threaded means, a cooperating lip and groove combination and a sliding, frictional engagement. Berls further discloses that the cover may be made partially or entirely of clear or transparent materials such as Lucite (registered trademark) or Plexiglass (registered trademark).

Houlihan discloses a cosmetic holder and dispenser for lipstick including a closure cap or cover 25 which is releasably secured to a ring 27 which, in turn, is free to turn relative to the other elements of the dispenser. The patent speaks of "spring action between the closure cap and the ring . . . " in terms of releasably securing the closure cap to the ring. The ring, though free to rotate, is held captive between an end cap or finger grip 23 and a casing 10.

Although the prior art contains several disclosures of clear cosmetic dispenser covers, the cosmetic industry today is distributing lipstick in dispensers predominantly provided with opaque covers. This presents a significant problem for anyone who owns more than one tube of lipstick with an opaque cover. Selecting the most appropriate lipstick from such a collection requires the removal of each opaque cap to permit a comparison of each available color and, ultimately, the proper selection of a lipstick color. If all lipstick dispensers were of a uniform size, a single size clear cover would fit all lipstick tubes and the problem referred to above could be solved by such a cover. However, lipstick tubes are not all of uniform size. Lipstick tubes are not even all of a uniform shape, although the majority are cylindrical. In fact, the number of variations in lipstick tube sizes and shapes is really rather remarkable. Accordingly, a given clear cover for a lipstick dispenser will fit a limited and, in most cases, very limited number of dispensers and would not adequately address this problem.

SUMMARY OF THE INVENTION

The present invention is concerned with a universal cover for cosmetic dispensers which eliminates the problem noted above in connection with the selection of a lipstick from a collection of several lipstick tubes having opaque covers. The cover comprises a body and a retainer secured to one end of the cover for securing the cover body to, for example, any one of a number lipstick tubes having a wide variety of tube shapes and sizes. Preferably, the retainer comprises a ring of foam adhered or otherwise secured to the cover body adjacent to an open end of the cover body. It is also preferred that at least a portion of the cover body be transparent so that one can view a cosmetic in a cosmetic dispenser with the cover secured thereto.

Accordingly, it is an object of the invention to provide a novel cover which has universal application for dispensers of various sizes and shapes.

It is a further object of this invention to provide a universal cosmetic dispenser cover which is clear enough to enable one to view the cosmetic in the dispenser with the cover secured thereto.

It is yet another object of this invention to provide a kit including a plurality of such covers which can be used to replace less useful covers in an individual's collection of lipstick.

It is yet another object of this invention to provide a cover which eliminates the problem of having to sequentially remove covers from a collection of lipsticks in order to select the best color lipstick from the collection, despite differences in the sizes and shapes of the lipstick tubes in the collection of lipsticks.

These and other objects and advantages of the present invention will no doubt become apparent to those skilled in the art after having read this detailed description of the invention including the following description of the preferred embodiment which is illustrated by the various drawing figures.

DETAILED DESCRIPTION OF THE PREFERRED EMBODIMENTS

Figure 1:
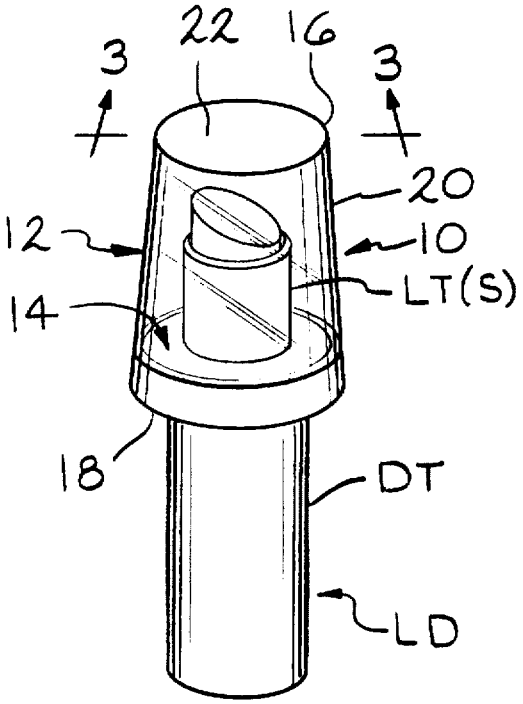
FIG. 1 is a perspective view of a cover according to the present invention in a closed position relative to a lipstick dispenser with a lipstick tube having a relatively small diameter.

Referring to FIG. 1, a universal cover according to the invention, indicated generally at 10, is in a closed position on a lipstick dispenser LD. The cover 10 comprises a cover body 12 and a retainer 14. The retainer 14 is secured, for example, by adhesive (not shown) to the cover body 12. The cover body 12 has a closed end 16 and an open end 18. The retainer 14 is secured to the cover body 12, adjacent to its open end 18. Preferably, the cover body 12 is made entirely of a transparent polymeric material and can be produced by injection molding. Although it is less preferred, the cover body 12 can be made of a material which, though not transparent, is translucent to the extent that one looking through the cover body at a colored object can distinguish or identify the color of the object. Materials having this property will be referred to herein as color transparent with the understanding that a transparent material is also color transparent. Alternatively, the cover body 12 can be a composite in the sense that it can be made of two or more materials, provided that at least one of the materials is color transparent.

For ease of manufacturing, it is preferred that the cover body 12 be of single piece construction. In the drawing, the cover body 12 is one piece comprising a side wall 20 having the shape of a truncated cone and an end 22 at the closed end 16 of the cover body 12. The shape of the side wall 20 will facilitate the release of a cover body 12 from a mold, while providing a pleasing appearance. It will be appreciated, however, that the cover body 12 may be made in other shapes, consistent with the objectives and the features of the present invention.

The retainer 14 is secured to the cover body 12, adjacent its open end 18, and specifically, the retainer 14 is secured to the inside surface of the side wall 20. The retainer 14 is preferably made of a resilient material so that it can grippingly engage the outside surface of a lipstick tube LT(S) having a relatively small diameter, as shown in FIGS. 1 and 3, as well as the outside surface of a lipstick tube LT(L) having a relatively large diameter, as shown in FIGS. 2 and 3.

It is believed that, without exception, lipstick dispensers include a lipstick tube LT having a first circumference, inside of a dispenser tube DT having a second circumference which is greater than circumference of the lipstick tube LT. The upper end of the dispenser tube DT forms a shoulder S (FIG. 2) on which the retainer 14 can rest when it is in a closed position relative to the lipstick dispenser LD.

Figure 3:
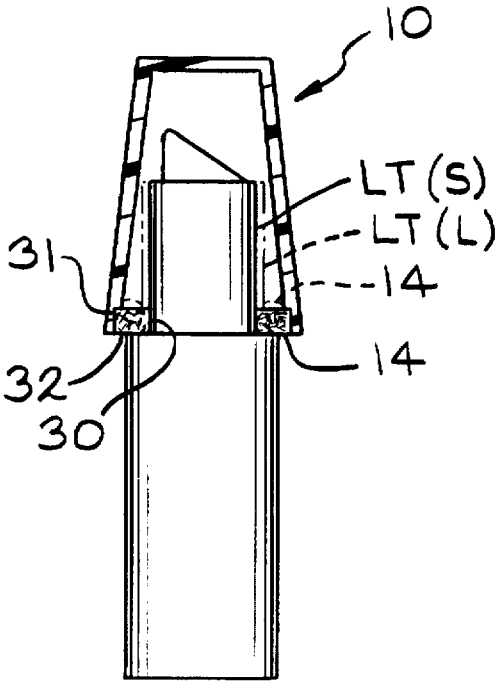
FIG. 3 is a cross-sectional view of the cover illustrated in FIGS. 1 and 2, taken along the line 3—3 of FIG. 1.

Referring now to FIG. 3, the universal cover 10 is in a closed position on a lipstick dispenser LD including a lipstick tube LD(S) having a relatively small circumference. An inner surface 30 of the retainer 14 is snugged up against the outside surface of the lipstick tube LT(S). A lipstick tube with a larger circumference LT(L) is shown in phantom lines. The inner surface 30 of the retainer 14 defines a cylinder and the circumference of that cylinder is less than the circumference of the lipstick tube LT(S) which, in turn, is less than the circumference of the lipstick tube LT(L). It will be appreciated that, because of the resilient nature of the retainer 14, it will compress, as needed, to accommodate either lipstick tube. The inner surface 30 of the retainer 14 is operable to frictionally engage the outside of the lipstick tube LT(S) as well as the outside surface of the lipstick tube LT(L). In the latter case, the retainer 14 will be compressed, somewhat, and will bulge, somewhat, as indicated by phantom line 14 in FIG. 3. The inside surface 30 of the retainer 14 need not have a cylindrical shape. Other shapes will be operable to provide the requisite frictional engagement with a variety of lipstick tube outer surfaces. In fact, it is not necessary that all of the inside surface of the retainer engage the lipstick tube. Adequate gripping could be achieved a retainer having, for example, an irregular surface.

Figure 2:
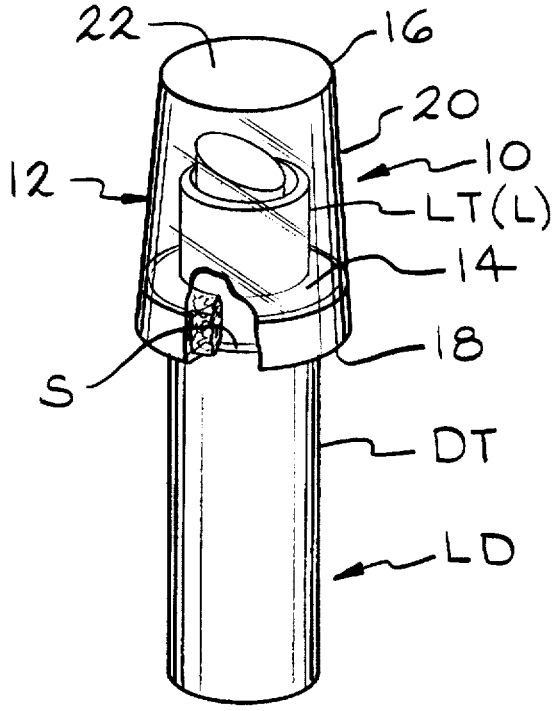
FIG. 2 is a perspective view of a cover according to the present invention, partially broken away, in a closed position relative to a lipstick dispenser with a lipstick tube having a relatively large diameter.
Figure 4:
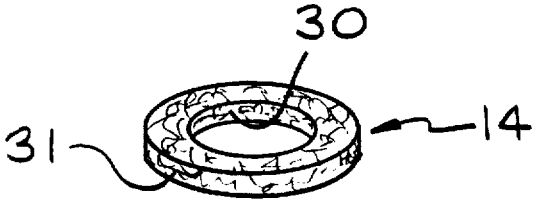
FIG. 4 is a perspective view of a retainer which is secured to a cover body in a cover according to the present invention.

The retainer 14 has an outer surface 31 and, in the embodiment illustrated in FIGS. 1, 2 and 4, this outer surface 31 is in contact with a surface 32 of a groove formed on the inside of the cover body 12, adjacent its open end 18. It is preferred that the retainer be sized, relative to the cover body 12, so that the retainer 14 presses lightly against the surface 32. It is also preferred that the retainer 14 be bonded, adhered or otherwise secured to the cover body 12. In the embodiment of FIGS. 1, 2 and 4, this is done at the interface between the retainer surface 31 and the cover body surface 32. Virtually any adhesive, compatible with the materials of the cover body 12 and the retainer 14, can be used to adhere these parts and a number of bonding techniques would also suffice. There is a significant amount of stress exerted on the connection between the retainer 14 and the cover body 12 as the cover 10 is moved into and out of a closed position relative to a dispenser, especially one having a lipstick tube with a relatively large circumference.

Referring now to FIG. 4, the retainer 14 is shown in detail. In this embodiment, the retainer 14 comprises a washer shaped piece of resilient material. Foam, such as urethane foam, is believed to be well suited for this application. Numerous types of foam are suitable for the retainer 14, as are other resilient materials and the selection of an appropriate resilient material for the retainer is something that would be well within the capacity of one skilled in the art.

Figure 5:
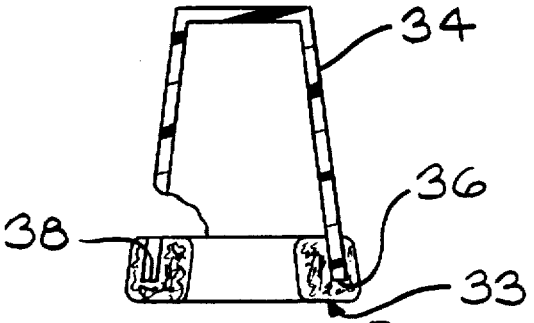
FIG. 5 is a cross sectional view of a cover according to the present invention and including a modified retainer.

Referring now to FIG. 5, an alternative embodiment of a retainer is indicated at 33, secured to a cover body 34. The retainer 33 also has the shape of a washer, but has an exterior diameter which is greater than the diameter of the cover body 34, adjacent to its open end 36. A portion of the cover body open end 36 is received in a circular groove, the bottom of which is indicated at 38, formed in the retainer 33. The groove is cylindrical and extends in a generally axial direction. Conveniently, cover body 34 may be secured to the retainer 33 by the application of adhesive to the open end of the cover body 34, the retainer groove or its bottom 38, or both, before the parts are assembled in the manner illustrated in FIG. 5. The cover body 34 is similar to cover body 12 but does not necessarily include the groove adjacent to the open end of the cover body 12 (FIG. 3)

The foregoing description is intended to enable one skilled in the art to make and use a cover according to the present invention, but not to limit the scope of the cover invention claimed herein. Modifications to the disclosed cover will undoubtedly occur to those skilled in the art and, so far as such modifications fall within the scope of the following claims, they are a part of this invention.

What is claimed is:

1. A universal cover for a plurality of different lipstick dispensers including dispensers having a lipstick tube having a first, relatively small circumference and dispensers having a lipstick tube having a second, relatively large circumference, said cover comprising, in combination, a cover body having a first, open end and a second, closed end, said body being made, in whole or in part, from a material which is color transparent, wherein said first end has a circumference which is greater than the second circumference, and a resilient retainer having at least one connector surface and a gripping surface, said connector surface being adhesively secured to said cover body, adjacent to said first end thereof, said gripping surface being operable, when said cover is positioned to close any one of the plurality of dispensers, to frictionally engage the lipstick tube thereof, thereby supporting said cover body on said any one of the plurality of dispensers so that it covers the lipstick tube and so that said second end of said cover body is held by the engagement of said retainer with the lipstick tube in a position where said cover body does not contact the lipstick tube.

2. The cover claimed in claim 1 wherein said cover body is entirely translucent.

3. The cover claimed in claim 1 wherein said retainer is generally washer-shaped.

4. The cover claimed in claim 3 wherein a cylindrical, axially extending groove is formed in said retainer.

5. The cover claimed in claim 4 wherein said first end of said cover body is carried in said groove.

6. The cover claimed in claim 1, wherein said retainer is made of urethane foam.

7. The cover claimed in claim 1 wherein said cover body comprises a side wall having the shape of a truncated cone having a large end and a small end and an end wall closing said large end of said cover body.

8. A kit comprising a plurality of universal covers for a plurality of different lipstick dispensers including dispensers having a lipstick tube having a first relatively small circumference and dispensers having a lipstick tube having a second, relatively large circumference, each of said covers comprising, in combination, a cover body having a first, open end and a second, closed end, said body being made from a material which is transparent, wherein said first end has a circumference which is greater than the second circumference, and a resilient retainer having at least one connector surface and a gripping surface, said connector surface being adhesively secured to said cover body, adjacent to said first end thereof, said retainer being shaped so that at least a portion of the retainer extends radially inwardly from said first open end, said gripping surface of said retainer being operable, when said cover is positioned to close any one of the plurality of dispensers, to frictionally engage the lipstick tube thereof, thereby supporting said cover body on said any one of the plurality of dispensers so that it covers the lipstick tube and so that said second end of said cover body is held by the engagement of said retainer with the lipstick tube in a position where said cover body does not contact the lipstick tube.

9. A universal cover for a plurality of different lipstick dispensers including dispensers having a lipstick tube having a first, relatively small circumference and dispensers having a lipstick tube having a second, relatively large circumference, said cover comprising, in combination, a cover body having a first, open end and a second, closed end, said body being made from a material which is transparent, wherein said first end has a circumference which is greater than the second circumference, and a resilient retainer having at least one connector surface and a gripping surface, said connector surface being adhesively secured to said cover body, adjacent to said first end thereof, said retainer being shaped so that at least a portion of the retainer extends radially inwardly from said first open end, said gripping surface of said retainer being operable, when said cover is positioned to close any one of the plurality of dispensers, to frictionally engage the lipstick tube thereof, thereby supporting said cover body on said any one of the plurality of dispensers so that it covers the lipstick tube and so that said second end of said cover body is held by the engagement of said retainer with the lipstick tube in a position where said cover body does not contact the lipstick tube.

* * * * *